US005229818A

United States Patent [19]

Nakahara et al.

[11] Patent Number: 5,229,818

[45] Date of Patent: Jul. 20, 1993

[54] IMAGE FORMING APPARATUS HAVING A HIGH VOLTAGE POWER SOURCE FOR A CONTACT CHARGER

[75] Inventors: Takashi Nakahara; Shunichi Masuda, both of Kawasaki; Toshio Yoshimoto, Yokohama; Kenjiro Hori, Yokohama; Satoshi Akiyama, Yokohama; Yoshimi Kuramochi, Yokohama; Yasuhiro Nakata, Yokohama, all of Japan

[73] Assignee: Canon Kabushiki Kaisha, Tokyo, Japan

[21] Appl. No.: 757,596

[22] Filed: Sep. 11, 1991

[30] Foreign Application Priority Data

Sep. 14, 1990 [JP] Japan ..... 2-242564
Sep. 14, 1990 [JP] Japan ..... 2-242565

[51] Int. Cl.[5] ..... G03G 15/00

[52] U.S. Cl. ..... 355/222; 355/203; 355/219

[58] Field of Search ..... 355/219, 216, 271, 273, 355/274, 276, 221, 222, 208, 203-207, 209; 361/225, 229, 230

[56] References Cited

U.S. PATENT DOCUMENTS 3,604,925 9/1971 Snelling ..... 355/219 X
3,908,164 9/1975 Parker ..... 323/75 K
4,239,373 12/1980 Weikel, Jr. ..... 363/89
4,353,970 10/1982 Dryczynski ..... 361/225 X
4,435,677 3/1984 Thomas ..... 323/235
4,504,139 3/1985 Nozaki et al. ..... 355/69
4,783,716 11/1988 Nagase et al. ..... 361/225
5,006,902 4/1991 Araya ..... 355/271

FOREIGN PATENT DOCUMENTS 0280542 8/1988 European Pat. Off. .
0338546 10/1989 European Pat. Off. .

*Primary Examiner*—A. T. Grimley
*Assistant Examiner*—T. A. Dang
*Attorney, Agent, or Firm*—Fitzpatrick, Cella, Harper & Scinto

[57] ABSTRACT

An image forming apparatus, which is capable of obtaining high quality images, having a recording member on which a latent image is formed, a charging voltage generating portion which is positioned in contact with the recording member for the purpose of applying charging voltage containing an AC component to the recording member and from which said charging voltage is supplied, an application device for applying an AC component having a frequency, which is different from that of the AC component of the charging voltage, to the recording member, an electric current value control circuit for detecting an output AC value of the charging voltage generating portion so as to make the output AC value to be a predetermined value, and an erroneous operation preventing circuit for preventing an erroneous operation of the electric current value control circuit taken place due to an introduction of the AC component applied by the application device into the charging voltage generating portion.

13 Claims, 6 Drawing Sheets

1
2
3
4
5
6
7
8
9
10
11
12
13
14
15
16
17
18
19
20
21
22
FREQUENCY DISCRIMINATION CIRCUIT
CONSTANT-CURRENT CONTROL CIRCUIT
AMPLIFICATION FACTOR CONTROL CIRCUIT
OUTPUT IMPEDANCE CIRCUIT
AMPLIFIER CIRCUIT
AC OSCILLATION CIRCUIT
DC VOLTAGE GENERATING CIRCUIT
OUTPUT IMPEDANCE CIRCUIT
AMPLIFIER CIRCUIT
AC OSCILLATION CIRCUIT
DC VOLTAGE GENERATING CIRCUIT
TRANSFER VOLTAGE GENERATING SECTION 2
24
ZP
23
ZD
Cp
24
Rp1
Rp2
IMPEDANCE EQUIVALENT TO Zp
C7
C6
15
R5
C5
D3
D2
C4
R4
Vref
COP1
D1
16
AMPLIFICATION FACTOR CONTROL CIRCUIT
17
DC VOLTAGE GENERATING CIRCUIT
18
R1
C3
R3
R2
C2
14
T1
C1
Vcc
Q1
Q2
13
AMPLIFIER CIRCUIT
AC OSCILLATION CIRCUIT
12
DEVELOPING VOLTAGE GENERATING CIRCUIT
3

1
2
3
4
5
6
7
8
9
10
11
12
13
14
16
17
18
19
20
21
22
25
CONSTANT CURRENT CONTROL CIRCUIT
AMPLIFICATION FACTOR CONTROL CIRCUIT
OUTPUT IMPEDANCE CIRCUIT
FREQUENCY DISCRIMINATION CIRCUIT
AMPLIFIER CIRCUIT
AC OSCILLATION CIRCUIT
DC VOLTAGE GENERATING CIRCUIT
OUTPUT IMPEDANCE CIRCUIT
AMPLIFIER CIRCUIT
AC OSCILLATION CIRCUIT
DC VOLTAGE GENERATING CIRCUIT
TRANSFER VOLTAGE GENERATING SECTION

24
Zp
23
ZD
Cp
24
Rp1
Rp2
IMPEDANCE EQUIVALENT TO Zp
2
C3
R3
R1
R2
C2
14
DEVELOPING VOLTAGE GENERATING CIRCUIT
3
C7
C6
15
R5
C5
D3
D2
C4
R4
COP1
D1
16
DC VOLTAGE GENERATING CIRCUIT
18
T1
C1
Q1
Q2
Vcc
69
F / V CONVERTER
13
AMPLIFIER CIRCUIT
AMPLIFICATION FACTOR CONTROL CIRCUIT
17
AC OSCILLATION CIRCUIT
12

IMAGE FORMING APPARATUS HAVING A HIGH VOLTAGE POWER SOURCE FOR A CONTACT CHARGER

BACKGROUND OF THE INVENTION

1. Field of the Invention apparatus for forming an electrostatic image, and specifically relates to an image recording apparatus having a high voltage power source for a contact charger.

2. Description of the Prior Art

Hitherto, an electrostatic image recording apparatus has employed a corona charge method so as to supply a charge to a photosensitive drum by means of the corona discharge method. Since a conventional electrostatic image recording apparatus utilizing the corona discharge method encounters problems of an excessively high corona discharge voltage level of 5 to 10 KV and generation of ozonic gas, there has recently been developed an image recording apparatus which employs a contact charge method in which a electrostatic process is performed by using the high potential power source circuit which uses a relatively low voltage level of 1 KV to 3 KV without generation of ozonic gas.

An electrostatic image recording apparatus of the above-described type is arranged in such a manner that the charging, developing and transferring potentials are established with respect to the potential of the core of the photosensitive drum as the reference potential. Usually, the ground (hereinafter called "GND") level of the high potential power source circuit is made to be the same as the potential level of the core of the photosensitive drum. In addition the charging, developing and transferring potentials are all generated in the high potential power source circuit while using the above-described GND level as the reference.

The output voltage (hereinafter called "charging output voltage") bias to be applied to the charger is obtained by superimposing an AC (Alternating Current) bias (hereinafter called "charging AC voltage") and a DC (Direct Current) bias (hereinafter called "charging DC voltage") in order to cause the performance of charging the photosensitive member to be sufficiently exhibited. In particular, the AC bias is subjected to a constant current control in order to correspond to the environmental change in the charging load impedance. Similarly the output voltage (hereinafter called "developing output voltage") bias to be applied to the developing unit is obtained by superimposing an AC bias (hereinafter called "developing AC voltage") and a DC bias (hereinafter called "developing DC voltage").

In order to form an image on the photosensitive layer by rotating the photosensitive drum, its core is connected to the GND level of the high potential power source circuit at a sliding contact. Therefore, if foreign matter is mixed with the sliding contact portion, the contact resistance is raised to several gigaohms ($10^9\Omega$). As a result, the reference potential of the photosensitive drum, the charger, the developing unit and the transferring device, which constitute the electrostatic image forming portion, becomes different from the GND level which is the reference potential of the high potential power source circuit. In an image forming apparatus which utilizes the corona discharge method, the AC impedance of the charger is several tens of megohms when viewed from the high potential power source circuit. Furthermore, the electric current is about hundreds of microamperes to several milli-amperes. Therefore, even if the contact resistance at the above-described sliding contact portion reaches several megohms, the charging performance of the photosensitive drum does not critically deteriorate. Furthermore, the developing output voltage bias does not deteriorate the charging output voltage bias.

However, in the case of the image recording apparatus which uses the contact charge method, the AC impedance is several megohms when the charger is viewed from the high potential power source. Furthermore, the AC impedance of the developing output voltage bias when the charging voltage generating circuit is viewed from the drum core is several megohms. Therefore, if the resistance of the sliding contact portion is hundreds of kilo-ohms to several megohms, the developing output voltage bias is undesirably introduced into the charging voltage generating circuit. As a result, the charging voltage output, and particularly, the constant current control circuit is adversely affected. Therefore, there arises a problem of generating an unsatisfactorily charged portion on the photosensitive drum causing an inferior image.

Furthermore, the above-described conventional structure does not provide means against the change in the equivalent impedance of the photosensitive member when viewed from the charger due to the frequency of the charging AC voltage. Therefore, there arises a problem of an unsatisfactory charge of the photosensitive drum if the frequency is raised due to the change in the environment or the characteristics or the like of the elements. There arises another problem of a dielectric breakdown of the photosensitive member if the frequency is lowered. Accordingly, the allowable width of the frequency of the charging AC voltage must be narrowed, causing the structure of the power supply circuit to become too complicated and resulting in an increase in the cost of the elements.

As an alternative to this, it might be feasible to employ a structure arranged in such a manner that the frequency of the charging AC voltage is positively changed for the purpose of overcoming the above-described problems.

SUMMARY OF THE INVENTION

Accordingly, an object of the present invention is to provide an image forming apparatus capable of overcoming the above-described problems experienced with the conventional technology.

An object of the present invention is to provide an image forming apparatus which is capable of preventing an adverse effect such as an unsatisfactory charge which can be caused from an introduction of other AC voltage into a charging voltage generating portion due to, for example, contact resistance of a sliding contact portion of a photosensitive drum.

In order to achieve the above-described object, according to one aspect of the present invention, there is provided an image forming device for an image recording apparatus comprising: a charging voltage generating portion for generating a charging voltage to be applied to a charger, which is positioned in contact with a photosensitive drum, by superimposing a DC voltage and a first AC voltage; and application means for generating a second voltage to be applied to the photosensitive drum by superimposing a second AC voltage, the frequency of which is different from that of the first AC voltage of the charging voltage, and the DC voltage, wherein the charging voltage generating portion includes a constant current control circuit for maintaining the AC charging current transmitted therefrom at a predetermined value and a frequency discrimination circuit for dividing the AC contained in the charging current and the AC transmitted from the application means so that an erroneous operation of the current control circuit, which can take place by an introduction of other AC current into the charging voltage generating portion, is prevented by the frequency discrimination circuit.

As a result of the structure thus-constituted, the charger positioned in contact with the photosensitive drum is applied with the charging voltage obtained by superimposing the DC voltage generated by the charging voltage generating portion and the AC voltage. At this time, the erroneous operation of the constant current control circuit can be prevented. Furthermore, the value of the AC contained in the charging current transmitted from the current control circuit of the charging voltage generating portion can be maintained at a predetermined value by the constant current control circuit.

As a result of the above-described control operation, the performance of charging the photosensitive drum can always properly be exhibited.

Another object of the present invention is to provide an image forming apparatus in which the change in the AC voltage to be applied to a photosensitive member due to the change in the frequency of the charging current can be prevented.

In order to achieve the above-described object, according to another aspect of the present invention, there is provided a high potential power source circuit for an image recording apparatus comprising a charging voltage generating portion for generating a charging voltage to be applied to a charger positioned in contact with a photosensitive drum by superimposing a DC voltage and an AC voltage, wherein the charging voltage generating portion has a constant current control circuit for maintaining the value of the AC contained in the charging current transmitted therefrom at a predetermined value so that a constant current control is performed by changing the value of the AC contained in the charging current by utilizing the change in the AC voltage frequency contained in the charging voltage.

As a result of the structure thus-constituted, the charger positioned in contact with the photosensitive drum is applied with the charging voltage obtained by superimposing the DC voltage generated by the charging voltage generating portion and the AC voltage.

When the AC voltage frequency contained in the charging voltage is changed, the charging voltage generating portion changes its AC value by utilizing the change in the AC frequency of the charging current transmitted from the constant current control circuit therein. Furthermore, the constant current control circuit performs the constant current control in which the AC in the charging current is maintained at a predetermined value.

Even if the AC impedance of the charging voltage generating portion is changed or if the frequency of the AC contained in the charging current is changed due to the change in the environment or the characteristics of the element, the photosensitive drum can be applied with proper AC voltage thanks to the above-described control operation.

Another object of the present invention is to provide an image forming apparatus in which the constant current circuit can be stably operated and the charging performance can be maintained at a predetermined level even if an AC other than the charging current is introduced into the charging voltage generating portion or if the charging frequency is changed due to a change in the impedance of the charging voltage generating portion.

Other and further objects, features and advantages of the invention will be appear more fully from the following description and drawings.

DESCRIPTION OF THE PREFERRED EMBODIMENTS

A preferred embodiment of a high potential power source circuit for an image recording apparatus according to the present invention will now be described.

Figure 1:
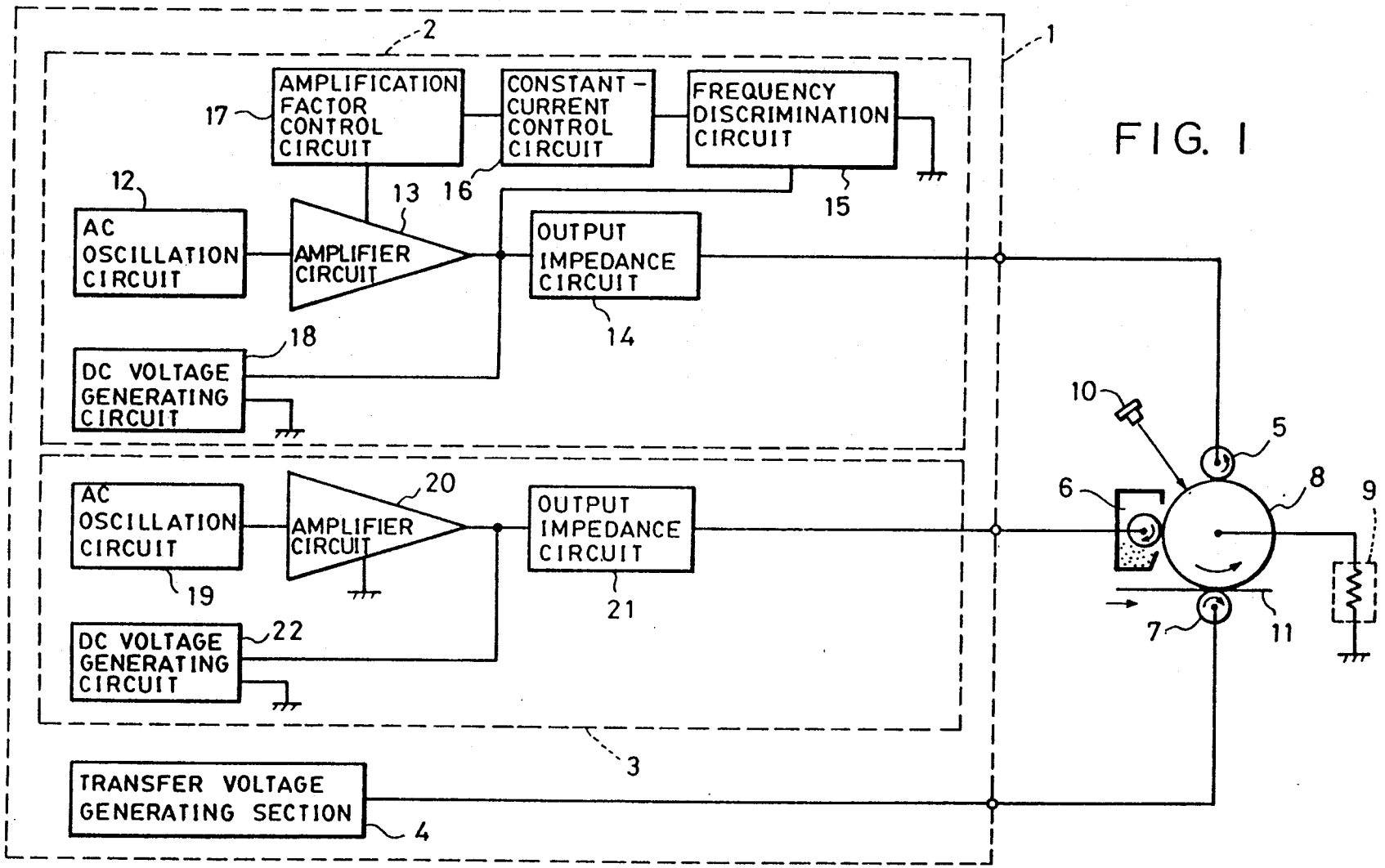
FIG. 1 is a block diagram which illustrates a first embodiment of the present invention.

FIG. 1 is a block diagram which illustrates a first embodiment of the present invention Referring to FIG. 1, a high potential power source circuit 1 of the image recording apparatus includes a charging voltage generating portion 2, a developing voltage generating portion 3 and a transfer voltage generating portion 4. The recording apparatus also has a charging roller 5 which is a charger to which the output voltage (hereinafter called "charging output voltage") from the charging voltage generating portion 2 is applied, and the charging roller 5 is positioned in contact with a photosensitive drum 8. A developing unit 6 is positioned in contact with the photosensitive drum 8, and the developing unit 6 is arranged to toner-develop an electrostatic latent image formed by a light emitting element 10 such as a laser diode or the like. According to this embodiment, the developing unit 6 is arranged to act in accordance with a development method which is disclosed in U.S. Pat. No. 4,395,476, and in which an alternating electric field is utilized by means of AC bias. A transfer roller 7 is also provided for transferring the toner image formed on a photosensitive drum 8 to a transfer medium 11 such as a paper sheet, and the transfer roller 7 is applied with voltage, the polarity of which is inverted to that of the toner, transmitted from the transfer voltage generating portion 4. A contact resistance 9 of a sliding contact portion exists between the core of the photosensitive drum 8 and GND level of the high potential power source circuit 1. The charging voltage generating portion 2 has an AC oscillation circuit 12 for applying charging AC voltage to the charging roller 5 via an amplifier circuit 13 and an output impedance circuit 14, and a frequency discrimination circuit 15 comprising a filter circuit for detecting an AC passing from the charging roller 5 to the high potential power source circuit GND via the core of the photosensitive drum 8 so as to generate voltage to be supplied to a constant current control circuit 16. A control level signal transmitted from the constant current control circuit 16 is used to control an amplification factor control circuit 17. An output from the amplification factor control circuit 17 is used to control the amplifier circuit 13 so that the amplitude of the charging AC voltage is controlled. A charging DC voltage generating circuit 18 is also provided for transmitting charging DC voltage, which is then superimposed on the charging AC voltage so that charging output voltage is obtained.

The developing voltage generating portion 3 includes an AC oscillation circuit 19 for generating an alternating field between the charging drum 8 and the developing unit 6, and the AC oscillation circuit 19 is superimposed on an output from a DC voltage generating circuit 22 via an amplifier circuit 20, and the DC voltage generating circuit 22 generates a DC a developing bias. As a result, developing output voltage with a superimposed DC and AC bias is applied to the developing unit 6 via an output impedance circuit 21.

Figure 2:
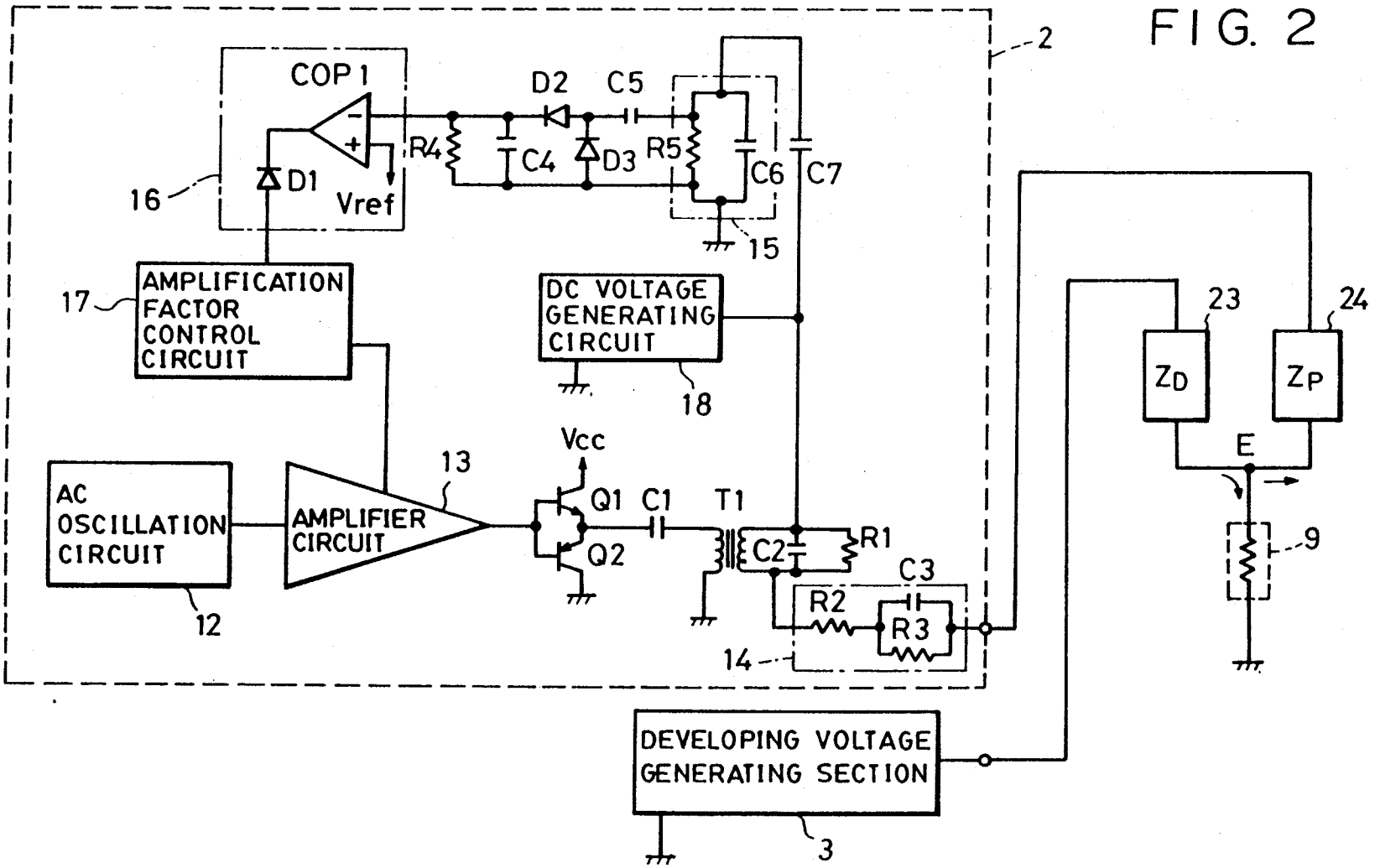
FIG. 2 is a circuit diagram which illustrates a charging voltage generating portion according to the first embodiment of the present invention.

FIG. 2 is a circuit diagram which illustrates the function of the charging voltage generating portion 2. The elements which are the same as those shown in FIG. 1 are given the same reference numerals and their descriptions are omitted here. Equivalent impedance $Z_D$ 23 is shown which is viewed from the output terminal of the developing voltage generating portion 3 to the image forming portion. Also equivalent impedance $Z_P$ is shown which is viewed from the output terminal of the charging voltage generating portion 2 to the electrostatic image forming portion.

Push-pull transistors Q1 and Q2 are provided for driving a transformer T1 via a capacitor C1 in accordance with the AC voltage supplied from the amplifier circuit 13. A resistor R1 and a capacitor C2 are load impedances of the charging AC voltage which is voltage-amplified by the transformer T1. The resistor R1 and the capacitor C2 protect the circuit when no external load is connected to the high potential power source circuit 1. The resistors R2, R3 and a capacitor C3 constitute the output impedance circuit 14. A resistor R4, capacitors C4, C5, diodes D2 and D3 constitute a voltage doubler rectifier circuit acting to convert the AC voltage at the two ends of the resistor R5 into a DC voltage so as to supply it to the negative input terminal of a comparator COP1. The COP1 makes a comparison between reference voltage $V_{ref}$ and the output from the above-described voltage doubler rectifier circuit so as to control the cathode voltage of the diode D1. The comparator COP1 and the diode D1 constitute a constant current control circuit 16.

The amplification factor control circuit 17 controls the amplification factor of the AC voltage in accordance with the anode voltage level of the diode D1. The resistor R5 and the capacitor C6 of the frequency discrimination circuit 15 constitute a filter circuit. A capacitor C7 cuts the DC voltage component of the charging output from the charging voltage generating portion 2. The output voltage from the charging voltage generating portion 2 is applied to the load $Z_P$ from the transformer T1 via the resistors R2, R3 and the capacitor C3. The charging AC returns to the transformer T1, from the load $Z_P$ via the high potential power source voltage circuit GND, the filter circuit, which is composed of the resistor R5 and the capacitor C6, and the capacitor C7. At this time, the above-described constant current control is performed in accordance with the AC voltage generated at the two ends of the resistor R5.

The AC component transmitted from the developing voltage generating portion 3 is applied to the developing load $Z_D$. When the value of the contact resistance 9 of the sliding contact portion is zero, the developing AC current returns to the developing voltage generating circuit via the high potential power source circuit GND. However, if the contact resistance 9 is generated at the sliding contact portion, the developing AC current is introduced into the circuit of the charging voltage generating portion 2 by virtue of the contact resistance 9 and the ratio of the impedance viewed from contact E to the charging portion. The developing AC current introduced into the circuit of the charging voltage generating portion 2 generates AC voltage at the two ends of the resistor R5, potentially causing the constant current control circuit 16 to be operated erroneously. Therefore, by setting a filter constant of the resistor R5 and the capacitor C6 in such a manner that the AC voltage, which is able to cause the above-described erroneous operation to take place, cannot be generated at the two ends of the resistor R5 even if the developing AC current is introduced into the circuit of the charging voltage generating portion 2, the constant current control circuit 16, in which the charging AC passes through, can be operated normally.

Figure 3:
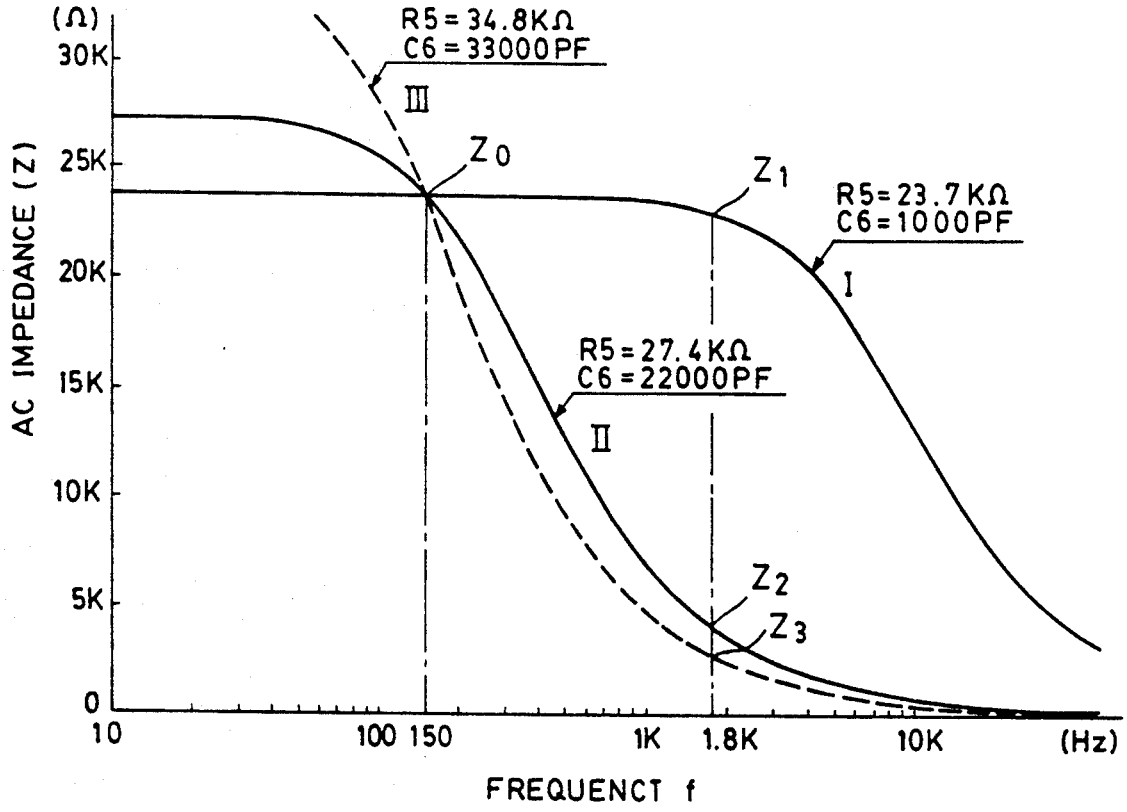
FIG. 3 is a graph which illustrates the AC impedance characteristics defined by filter circuit constants and frequencies.

FIG. 3 is a graph which illustrates the characteristics of the AC impedance. In, FIG. 3 where the absolute value $|Z|$ of the AC impedance of the resistor R5 and the capacitor C6 is illustrated for a case where the charging AC voltage frequency is 150 Hz and the developing AC voltage frequency is 1800 Hz. Curve I stands for the AC impedance $|Z|$ with respect to frequency f in a case where R5=23.7 KΩ and C6=1000 pF, Curve II stands for the same in a case where R5=27.4 KΩ and C6=2200 pF and Curve III stands for the same in a case where R5=34.8 KΩ and C6=3300 pF.

In the case of curve I, the AC impedance $|Z0|$ at the frequency of 150 Hz and that $|Z1|$ at the frequency of 1800 Hz are substantially the same. Therefore, if the developing AC is introduced into the charging voltage generating portion 2, AC voltage is generated at the two ends of the resistor R5, causing an erroneous operation to take place in the constant current control circuit 16.

In the cases of curves II and III, the AC impedances $|Z2|$ and $|Z3|$ at the frequency of 1800 Hz are extremely smaller in comparison to the AC impedance $|Z0|$ at the frequency of 150 Hz. Therefore, even if the developing AC is introduced into the circuit of the charging voltage generating portion 2, the constant current control circuit 16 operates normally. The greater the difference between the AC frequency of the charging current and that of the developing current, the more satisfactory an effect can, of course, be obtained by the frequency discrimination circuit 15 composed of the resistor R5 and the capacitor C6.

That is, even if the developing AC is introduced into the charging voltage generating portion 2 from the developing unit 6 via the GND, the frequency discrimination circuit, formed by the filter circuit composed of the resistor R5 and the capacitor C6, distinguishes the charging AC and the developing AC so as to operate the constant current control circuit by using the charging AC. As a result, an adverse effect of the introduced developing AC can be eliminated.

Furthermore, another problem of the deterioration in the charging performance due to the change in the frequency of the charging output caused from the change in the impedance of the charging output portion can be overcome according to this embodiment. This effect will now be described.

Figure 4:
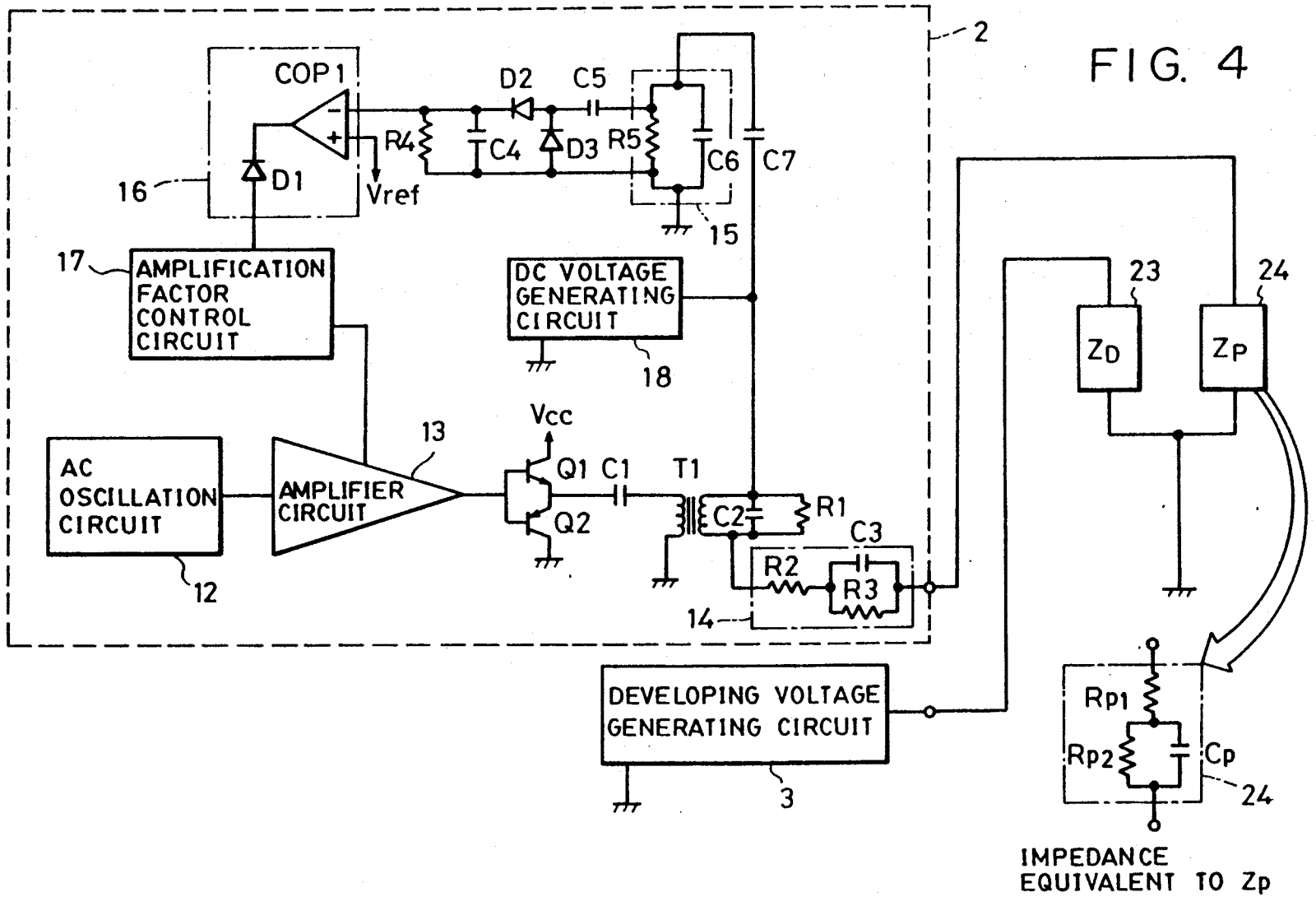
FIG. 4 is circuit diagram which illustrates an essential portion of the first embodiment of the present invention.

As shown in FIG. 4, the charge load impedance $Z_P$ can be equivalently be expressed by resistance $R_{p1}$ of the charging roller 5, and impedance $R_{p2}$ and $C_p$ of the photosensitive drum 8. In order to maintain the charging performance at a constant, the surface of the photosensitive drum 8 must be supplied with an AC voltage, the amplitude of which cannot be changed. However, since resistance $R_{P1}$ of the charging roller 5 changes due to the change in the environment or the like, the value of the charging current must be controlled to a constant value for the purpose of applying the AC voltage, the amplitude of which cannot be changed, to the photosensitive drum 8.

The impedance $Z_p$ of the photosensitive drum 8 can be expressed by a parallel connection constituted by resistor $R_{p2}$ and capacitor $C_p$. Therefore, when the frequency of the charging AC is changed, impedance $Z_p$ is also changed. As a result, even if the charging AC is constant-current-controlled, the amplitude of the charging AC voltage to be applied to the surface of the photosensitive drum will be undesirably changed.

According to the present invention, if the above-described frequency change takes place, the amplitude of the charging AC voltage to be supplied to the surface of the photosensitive drum can be maintained at a predetermined value.

The constant current control of the charging AC is, as described above, performed by comparing the voltage doubler rectifying output of the AC voltage at the two ends of the resistor R5 with voltage $V_{ref}$ at the positive input terminal of the COP1. In order to improve the constant current characteristics, generation of the high frequency noise component at the two ends of the resistor R5 is prevented by arranging the filter circuit in such a manner that the capacitor C6 is connected in parallel.

FIG. 3 is a graph which illustrates the AC impedance characteristics of the resistor R5 and the capacitor C6.

As described above, Curve I stands for the AC impedance $|Z|$ with respect to frequency f in a case where R5=23.7 KΩ and C6=1000 pF, Curve II stands for the same in a case where R5=27.4 KΩ and C6=2200 pF and Curve III stands for the same in a case where R5=34.8 KΩ and C6=3300 pF.

There has been a prior art device arranged in such a manner that a filter circuit having the characteristics of curve I is employed for the purpose of cutting the high frequency noise component and improving the constant current characteristics in a case where the nominal frequency of the charging AC voltage is 150 Hz. An assumption is made that the charge load impedance Zp, $R_{p1}$=0.5 MΩ, $R_{p2}$=100 MΩ and Cp=300 pF. In a case where 150 Hz sine wave the amplitude of which is 500 μA is applied to the charge load, the amplitude of the charging AC voltage to be applied to the surface of the photosensitive drum is 1765 V because the absolute value of the parallel impedance of $R_{p2}$ and $C_p$ is 3.53 MΩ. The absolute value of the parallel impedance of $R_{p2}$ and $C_p$ is 4.42 MΩ and the amplitude of the charging AC voltage at the surface of the photosensitive drum is 2210 V when the frequency is 120 Hz in the above-described state. In a case where the same is 180 Hz, the parallel impedance of $R_{p2}$ and $C_p$ is 2.95 MΩ and the amplitude of the charging AC voltage at the surface of the photosensitive drum is 1475 V. Assuming that the charging AC voltage amplitude at which the most suitable charging performance can be realized is 1765 V, a problem of an unsatisfactory charge takes place when the frequency is increased by 20% to 180 Hz. In a case where the frequency is reduced by 20% to 120 Hz, an abnormal discharge takes place, causing a risk to be generated in that the photosensitive insulating layer of the photosensitive drum will be broken.

Accordingly, according to this embodiment, the frequency discrimination circuit is employed which comprises the filter circuit 15 having the characteristics with which the constant current value is enlarged when the charging AC frequency is raised and the same is reduced when the charging AC frequency is lowered. As a result, satisfactory charging performance can always be exhibited even if the frequency is changed. An example of the characteristics of the filter circuit 15 according to this embodiment will now be described.

Curves II and III of FIG. 3 are curves which designate the AC impedance-frequency characteristics of the filter circuit exhibiting the above-described characteristics. Assuming that the controlled value of the charging AC amplitude of curve I at 150 Hz is 500 μA, the AC impedance increases in a case of curve II at frequency of 120 Hz such that the controlled value of the charging AC amplitude is 476 μA and the amplitude of the charging AC voltage at the surface of the photosensitive drum is 2103 V. Similarly, in a case where the frequency is 180 Hz, the AC impedance decreases such that the controlled value of the charging AC amplitude is 524 μA and the amplitude of the charging AC voltage at the surface of the photosensitive drum is 1546 V. In a case of curve III at the frequency of 120 Hz, the controlled value of the charging AC amplitude is 451 μA and the amplitude of the charging AC voltage at the surface of the photosensitive drum is 1993 V. Similarly, in a case where the frequency is 180 Hz, the controlled value of the charging AC amplitude is 559 μA and the amplitude of the charging AC voltage at the surface of the photosensitive drum is 1649 V.

As described above, the charging AC current value is changed in accordance with the change in the charging frequency, the amplitude of the charging AC voltage at the surface of the photosensitive drum can be maintained at a predetermined value.

Figure 5:
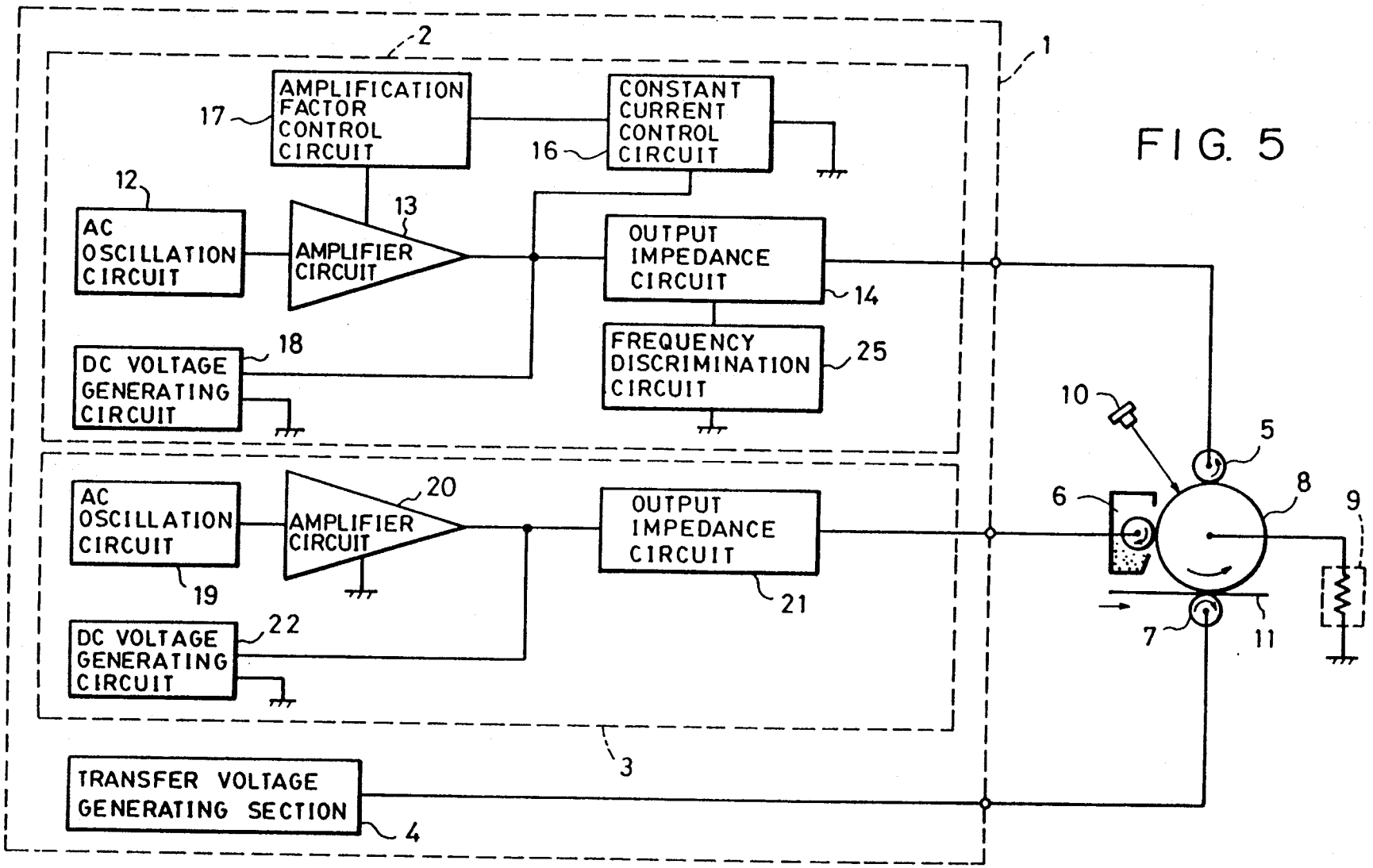
FIG. 5 is a block diagram which illustrates a second embodiment of the present invention.

FIG. 5 is a block diagram which illustrates a second embodiment of the present invention. The elements which are the same or equivalent to those shown in FIG. 1 are given the same reference numerals and their descriptions are omitted.

A frequency discrimination circuit 25 comprises a filter circuit which allows only the developing frequency components to pass through. If the developing AC current is introduced into the circuit of the charging voltage generating portion 2, only the developing AC currents are caused to flow into the high potential power source circuit GND via the frequency discrimination circuit 25 so that the constant current control circuit 16 cannot be affected.

As a result of the structure thus-constituted, the constant current control using only the charging frequency components can be performed.

Figure 6:
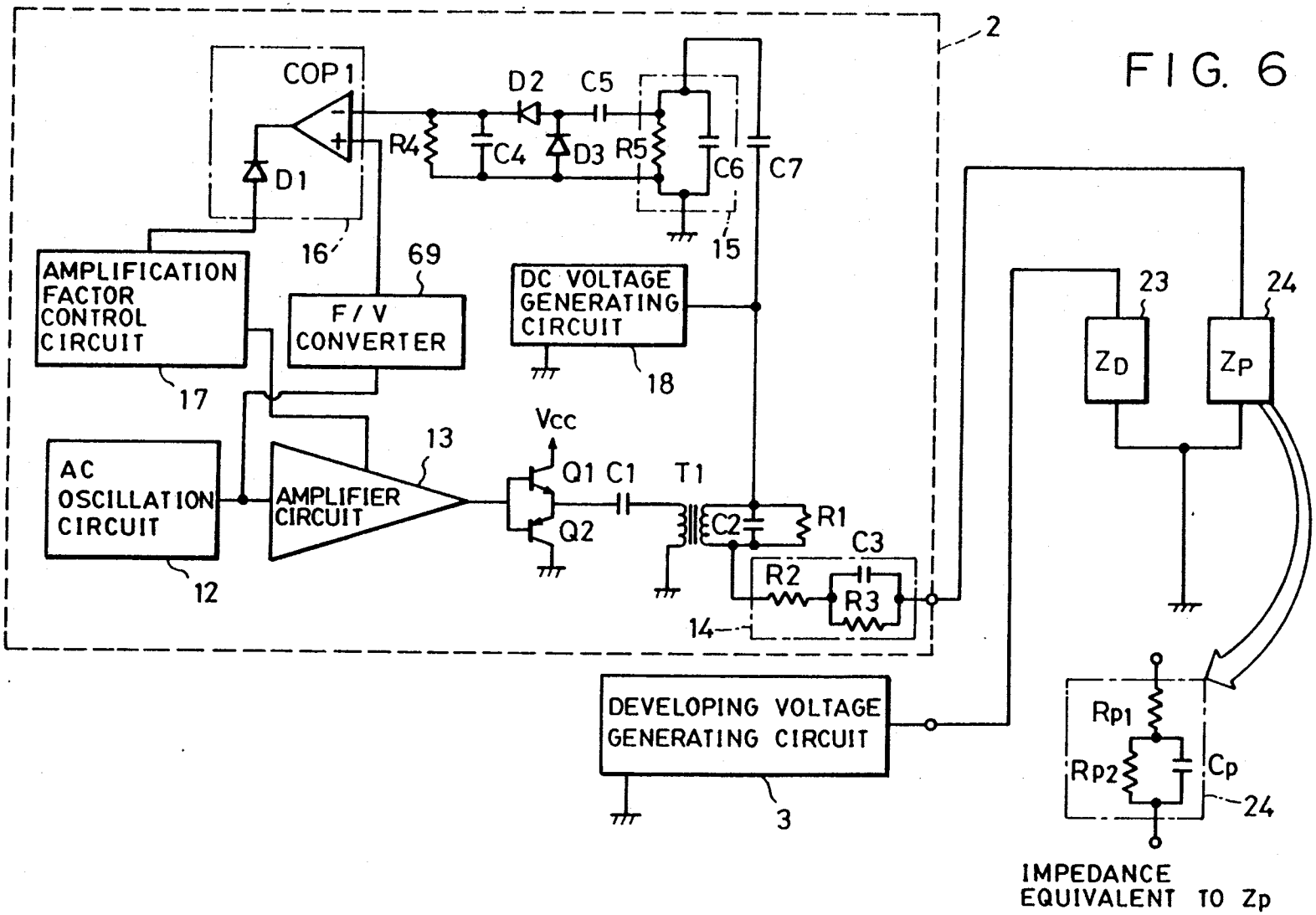
FIG. 6 is a circuit diagram which illustrates an essential portion of a third embodiment of the present invention.

FIG. 6 is a circuit diagram which illustrates an essential portion of a third embodiment of the present invention. The elements which are the same or equivalent to those shown in FIG. 4 are given the same reference numerals and their descriptions are omitted.

This embodiment is characterized in that a frequency-voltage conversion circuit 69 is provided which is able to control the constant current control circuit 16 by the output from the AC oscillation circuit 12. The frequency-voltage conversion circuit 69 transmits voltage, which is in proportion to the frequency of the AC oscillation circuit 12, to the positive input terminal of the comparator COP1 of the constant current control circuit 16. Therefore, if the frequency is raised, the voltage level at the COP1 is also raised, causing the charging AC current also to be raised. As described above, according to this embodiment, the AC current value is, similarly to the first embodiment, changed in accordance with the change in the AC frequency. Therefore, constant charging performance can be maintained.

In particular, an effect can be obtained in a recording apparatus which is capable of switching over the image resolution in that an undesirable generation of a moire image can be prevented by performing the constant current control in such a manner that the frequency of the charging AC voltage is changed in accordance with the image resolution. In this case, the above-described effect can easily be obtained according to the third embodiment.

As described above, according to the first and second embodiments of the present invention, the charger positioned in contact with the photosensitive drum is applied with charging voltage obtained by superimposing the a first DC voltage and a first AC voltage. On the other hand, the developing unit positioned in contact with the photosensitive drum is applied with developing voltage obtained by superimposing a second AC voltage and a second DC voltage, the frequency of the first AC voltage being different from that of the second AC voltage.

Furthermore, if the AC contained in the developing current is introduced from the developing unit into the charging voltage generating portion due to the contact resistance of the sliding contact portion of the photosensitive drum, the frequency discrimination circuit disposed in the charging voltage generating portion divides the AC contained in the charging current and the AC contained in the developing current transmitted from the constant current control circuit in the developing voltage generating portion. As a result, the constant current control circuit is operated by the AC contained in the charging current. Therefore, the erroneous operation of the constant current control circuit can be prevented so that the AC value contained in the charging current can be maintained at a constant value by the constant current control circuit. As a result, a high voltage power source circuit for an image recording apparatus capable of always exhibiting excellent charging performance can be provided.

As described above, according to the first and third embodiments of the present invention, the charger positioned in contact with the photosensitive drum is applied with charging voltage obtained by superimposing a DC voltage generated in the charging voltage generating portion and an AC voltage. The charging voltage generating portion changes the AC value in accordance with the change in the AC frequency in the charging voltage. Furthermore, the constant current control capable of maintaining the AC contained in the charging current is performed by the constant current control circuit. Therefore, even if the frequency of the AC voltage in the charging voltage is changed due to the change in the AC impedance of the electrostatic image forming portion, the change in the environment or the change in the characteristics of the element, proper charging AC voltage can be applied to the photosensitive drum. Therefore, the generation of an abnormal image due to the unsatisfactory charge can be prevented.

Furthermore, the accuracy level of the charging AC frequency can be lowered in comparison to the conventional technology. Therefore, the necessity of using expensive elements exhibiting excellent temperature characteristics can be eliminated causing the overall cost to be reduced.

In addition, according to the present invention, there is provided a high potential power source device for an image recording apparatus which is preferably adapted to an image recording apparatus of a type capable of effectively recording a proper image by changing the frequency of the charging AC voltage by the image resolution.

According to the first embodiment of the present invention, even if the AC for use in the development operation is introduced into the charging voltage generating portion, and if the impedance of the charging voltage generating portion is changed and thereby the charging frequency is changed, the constant current circuit can be stably operated. Furthermore, the charging performance can be maintained at a predetermined level.

Although the invention has been described in its preferred form, it is understood that the present disclosure of the preferred form has been changed in the details of construction and the combination and arrangement of parts may be resorted to without departing from the spirit and the scope of the invention as hereinafter claimed.

For example, although each of the above-described embodiments of the present invention is described about a case in which the developing unit applies the other AC component to the surface of the photosensitive drum, it is preferable that any of the following voltage be cut in order to further accurately perform the constant current control operation because any of the following voltages is able to contain an AC component: voltage to be applied to a transfer charger for performing the transfer operation; voltage to be applied to a pre-transfer charger disposed in front of the transfer unit and capable of causing the transfer operation to be easily performed; voltage to be applied to a separation charger for separating the transfer paper from the photosensitive member; voltage to be applied to a blade for cleaning residual toner on the photosensitive member; voltage applied to a cleaning pre-charger acting before the cleaning operation and capable of causing the cleaning operation to be performed easily; and voltage to be applied to an electricity removing charger for making the photosensitive member to have a uniform potential.

What is claimed is:

1. An image forming apparatus comprising:

a recording member on which a latent image is formable;

a charging voltage generating portion, which is positioned in contact with said recording member, for applying a charging voltage which contains a first AC component to said recording member;

application means for applying a voltage, which contains a second AC component having a frequency which is different from that of said first AC component, to said recording member;

a control circuit for detecting an AC output value of said charging voltage generating portion and for controlling said AC output value to a predetermined value; and 'an erroneous operation preventing circuit for preventing operation of said control circuit in accordance with said second AC component.

2. An image forming apparatus according to claim 1, wherein said erroneous operation preventing circuit cuts off the frequency of said second AC component.

3. An image forming apparatus according to claim 1, wherein said application means comprises a developing unit for developing a latent image formed on said recording member, and wherein said application means applies to said recording member an electric field formed by superimposing a DC bias with an AC bias.

4. An image forming apparatus according to claim 1, wherein said charging voltage generating portion includes a charging roller.

5. An image forming apparatus according to claim 2, wherein said erroneous operation preventing circuit includes frequency characteristics capable of changing said AC output value in accordance with a change in the first AC component.

6. An image forming apparatus comprising:

a recording member on which a latent image is formable;

a charging voltage generating portion, which is positioned in contact with said recording member, for applying a charging voltage which contains a first AC component to said recording member, said charging voltage generating portion including an electric current value control circuit for controlling an AC current value of said charging voltage generating portion to a predetermined value;

a controller by which said electrical current value control circuit is controlled in such a manner that the value of said AC current contained in said changing current is changed in accordance with a change of the first AC component; and an erroneous operation preventing circuit for preventing operation of said electric current value control circuit due to introduction of the first AC component.

7. An image forming apparatus according to claim 6, wherein said controller comprises a filter circuit having frequency characteristics capable of changing said AC current value in accordance with the change in frequency of the first AC component.

8. An image forming apparatus comprising:

a recording member on which a latent image is formable;

a charging voltage generating portion, which is positioned in contact with said recording member, for applying a charging voltage which contains a first AC component to said recording member, said charging voltage generating portion including an electric current value control circuit for controlling an AC current value of said charging voltage generating portion to a predetermined value; and a controller by which said electric current value control circuit is controlled in such a manner that the value of said AC current contained in said charging current is changed in accordance with a change of the first AC component, said controller comprising a frequency-voltage converter for controlling said electric current value control circuit by converting the frequency of said AC component into voltage.

9. An image forming apparatus according to claim 7, further comprising application means for applying a second AC component, having a frequency which is different from that of the first AC component, to said recording member, wherein said filter circuit has frequency characteristics capable of preventing the introduction of said second AC component into said electric current value control circuit.

10. An image forming apparatus comprising:

a recording member on which a latent image is formed;

a charging voltage generating portion, which is positioned in contact with said recording member, for applying a charging voltage containing a first AC component to said recording member, said charging voltage generating portion including a control circuit for detecting an AC current value of said charging voltage generating portion and for controlling said AC current value to a predetermined value;

application means for applying a second AC component, having a frequency which is different from that of the first AC component, to said recording member; and control means for preventing operation of said control circuit in accordance with said second AC component and for changing said predetermined value for said AC current value in accordance with a change in the frequency of said first AC component.

11. An image forming apparatus according to claim 10, wherein said control means comprises a filter circuit for cutting the frequency of said second AC component and having frequency characteristics capable of changing said predetermined value for said AC current value in accordance with the change in said frequency.

12. An image forming apparatus according to claim 10, wherein said application means comprises a developing unit for developing a latent image formed on said recording member, and wherein said application means applies to said recording member an electric field formed by superimposing a DC bias with an AC bias.

13. An image forming apparatus according to claim 10, wherein said charging voltage generating portion includes a charging roller.

* * * * *